US007810782B1

(12) United States Patent
Driscoll

(10) Patent No.: US 7,810,782 B1
(45) Date of Patent: Oct. 12, 2010

(54) CLOTHES CLEANING DEVICE SUPPORT SYSTEM

(76) Inventor: Mark M. Driscoll, P.O. Box 480, Vermillion, OH (US) 44089

( * ) Notice: Subject to any disclaimer, the term of this patent is extended or adjusted under 35 U.S.C. 154(b) by 0 days.

(21) Appl. No.: 12/200,109

(22) Filed: Aug. 28, 2008

(51) Int. Cl.
*F16M 3/00* (2006.01)

(52) U.S. Cl. ..... 248/673; 248/676; 248/346.01; 312/330.1

(58) Field of Classification Search ..... 248/673, 248/676, 678, 346.01, 346.03, 188.2; 68/3 R, 68/4, 5 R, 12.01, 212; 34/52–54; 134/56 D, 134/57 D; 312/330.1, 351.2, 31
See application file for complete search history.

(56) References Cited

U.S. PATENT DOCUMENTS 3,912,207 A * 10/1975 Gauer ..... 248/561
4,243,197 A 1/1981 Wright
4,253,402 A * 3/1981 Carrig et al. ..... 108/27
4,466,674 A * 8/1984 La Rose ..... 312/140.3
4,650,934 A * 3/1987 Burke ..... 200/5 R
4,796,333 A * 1/1989 Stinson et al. ..... 452/16
4,877,208 A * 10/1989 Kennard, Jr. ..... 248/146
4,936,117 A 6/1990 Kabeya
5,310,146 A 5/1994 Maguire
6,126,131 A * 10/2000 Tietz ..... 248/346.01
6,264,157 B1 7/2001 Muyskens
6,427,966 B1 8/2002 Blumenschein
6,585,225 B1 7/2003 Lake
D487,977 S * 4/2004 Hill ..... D6/500
6,923,419 B2 8/2005 George et al.
6,929,270 B1 * 8/2005 Flagstad et al. ..... 280/79.11
2006/0201299 A1 * 9/2006 Santa Ana ..... 83/468.3

* cited by examiner

*Primary Examiner*—Korie Chan

(57) ABSTRACT

A clothes cleaning device support system includes a clothes cleaning device for washing clothes, drying clothes or both washing and drying clothes. A mount for supporting the clothes cleaning device over a floor surface includes a top wall and a perimeter wall is attached to and extending downwardly from the top wall. The perimeter wall includes a pair of side walls, a rear wall and a front wall. The front wall has an access aperture therein to access an area below the top wall. The access aperture extends upwardly into a bottom edge of the perimeter wall and toward the top wall. The clothes cleaning device is positioned on the top wall to space the clothes cleaning device above a floor surface. A container is positionable under the top wall and is accessible through the access aperture.

1 Claim, 7 Drawing Sheets

CLOTHES CLEANING DEVICE SUPPORT SYSTEM

BACKGROUND OF THE INVENTION

Field of the Invention

The present invention relates to appliance support devices and more particularly pertains to a new appliance support device for positioning a front end loading clothes dryer or washer above a floor surface so that it more easily accessible and to provide storage space under the clothes dryer or washer.

SUMMARY OF THE INVENTION

The present invention meets the needs presented above by generally comprising a clothes cleaning device for washing clothes, drying clothes or both washing and drying clothes. A mount for supporting the clothes cleaning device over a floor surface includes a top wall and a perimeter wall is attached to and extending downwardly from the top wall. The perimeter wall includes a pair of side walls, a rear wall and a front wall. The front wall has an access aperture therein to access an area below the top wall. The access aperture extends upwardly into a bottom edge of the perimeter wall and toward the top wall. The clothes cleaning device is positioned on the top wall to space the clothes cleaning device above a floor surface. A container is positionable under the top wall and is accessible through the access aperture.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
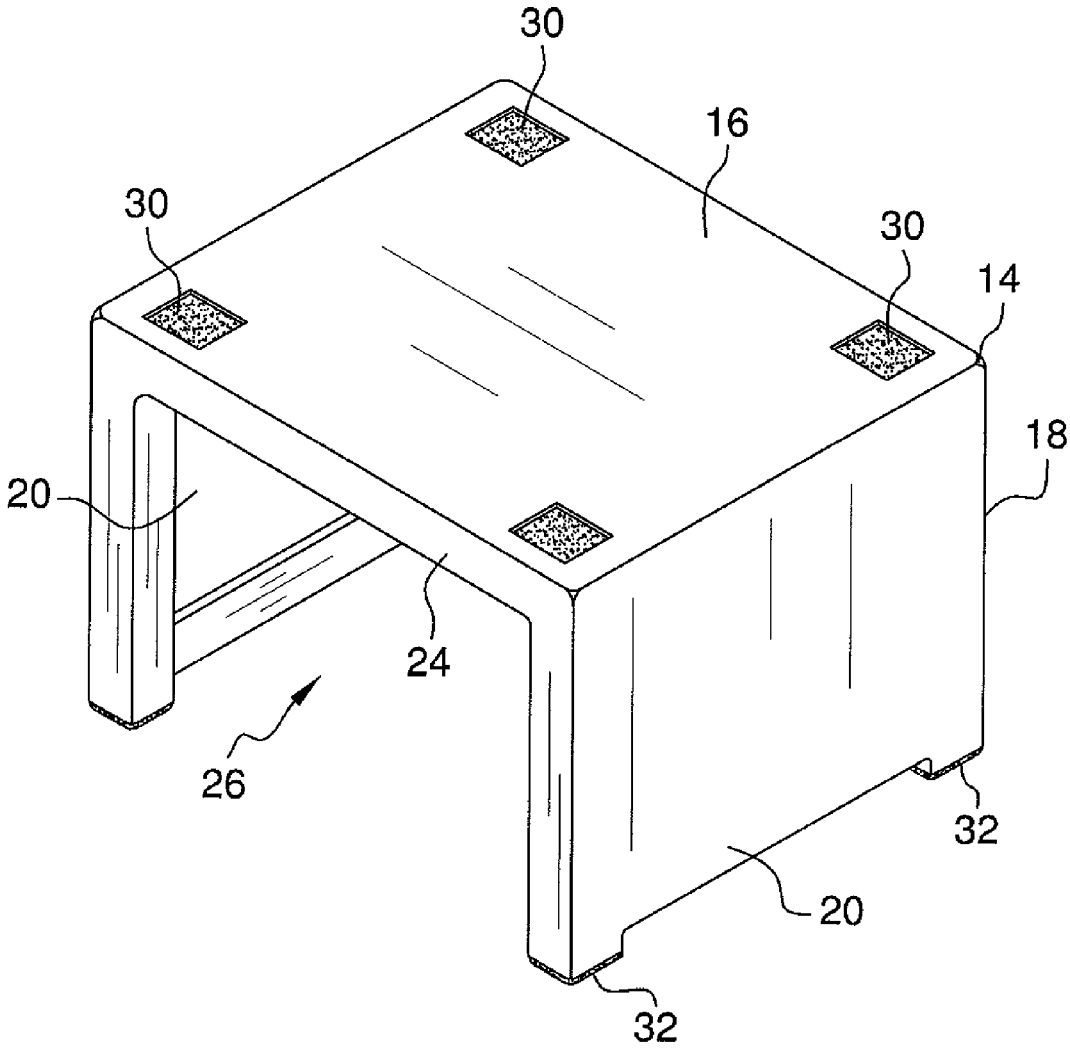
FIG. 1 is a front perspective view of a clothes cleaning device support system according to the present invention.
Figure 2:
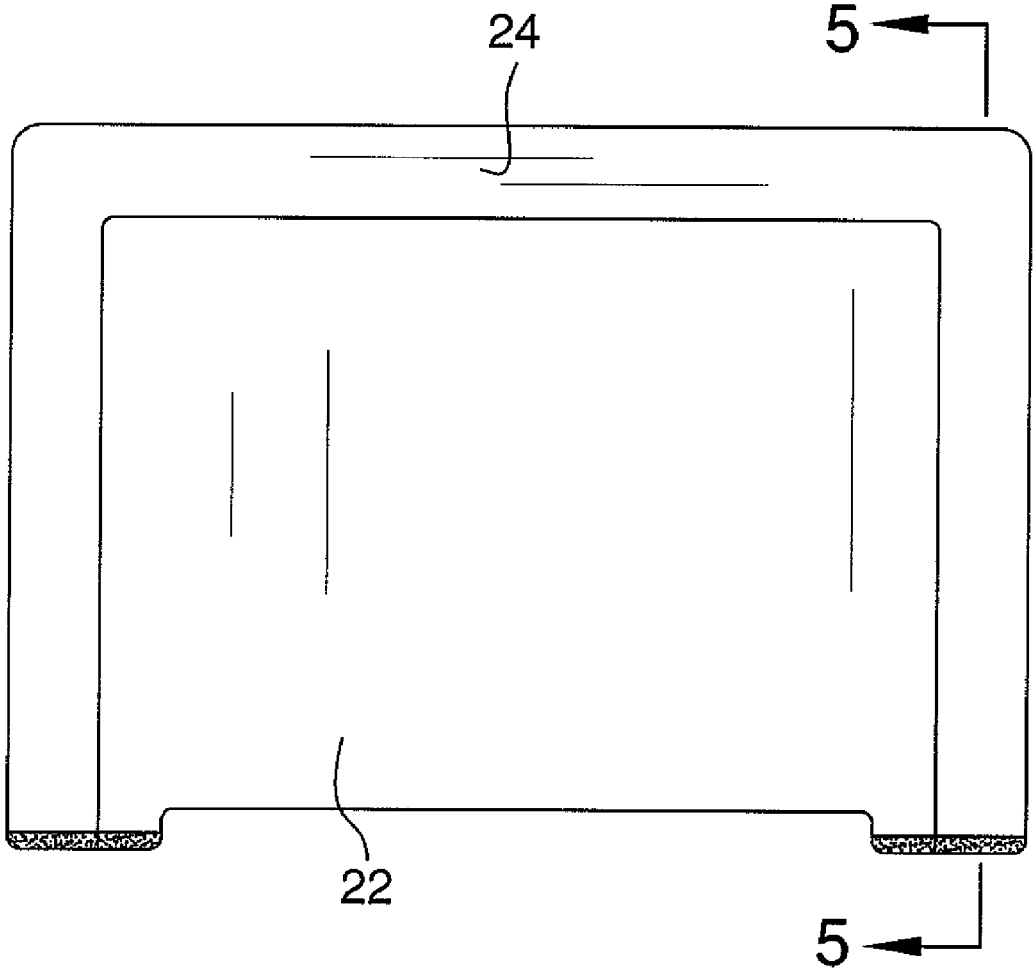
FIG. 2 is a front view of the present invention.
Figure 3:
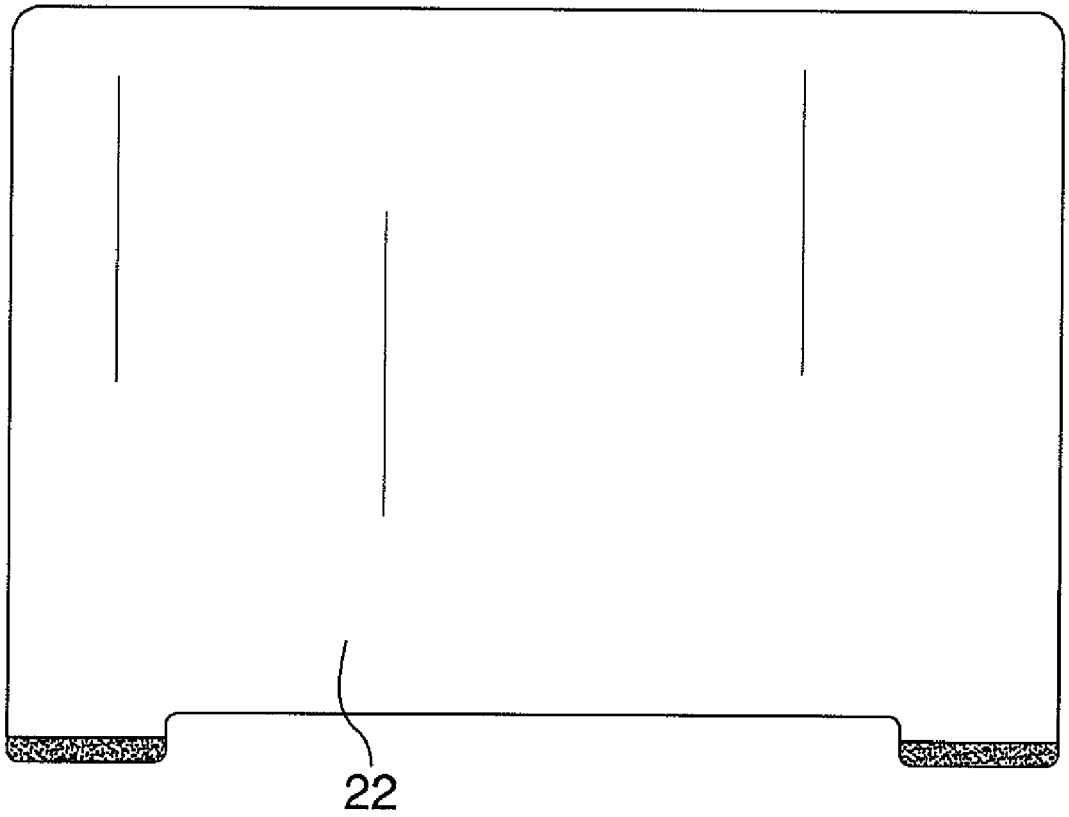
FIG. 3 is a rear view of the present invention.
Figure 4:
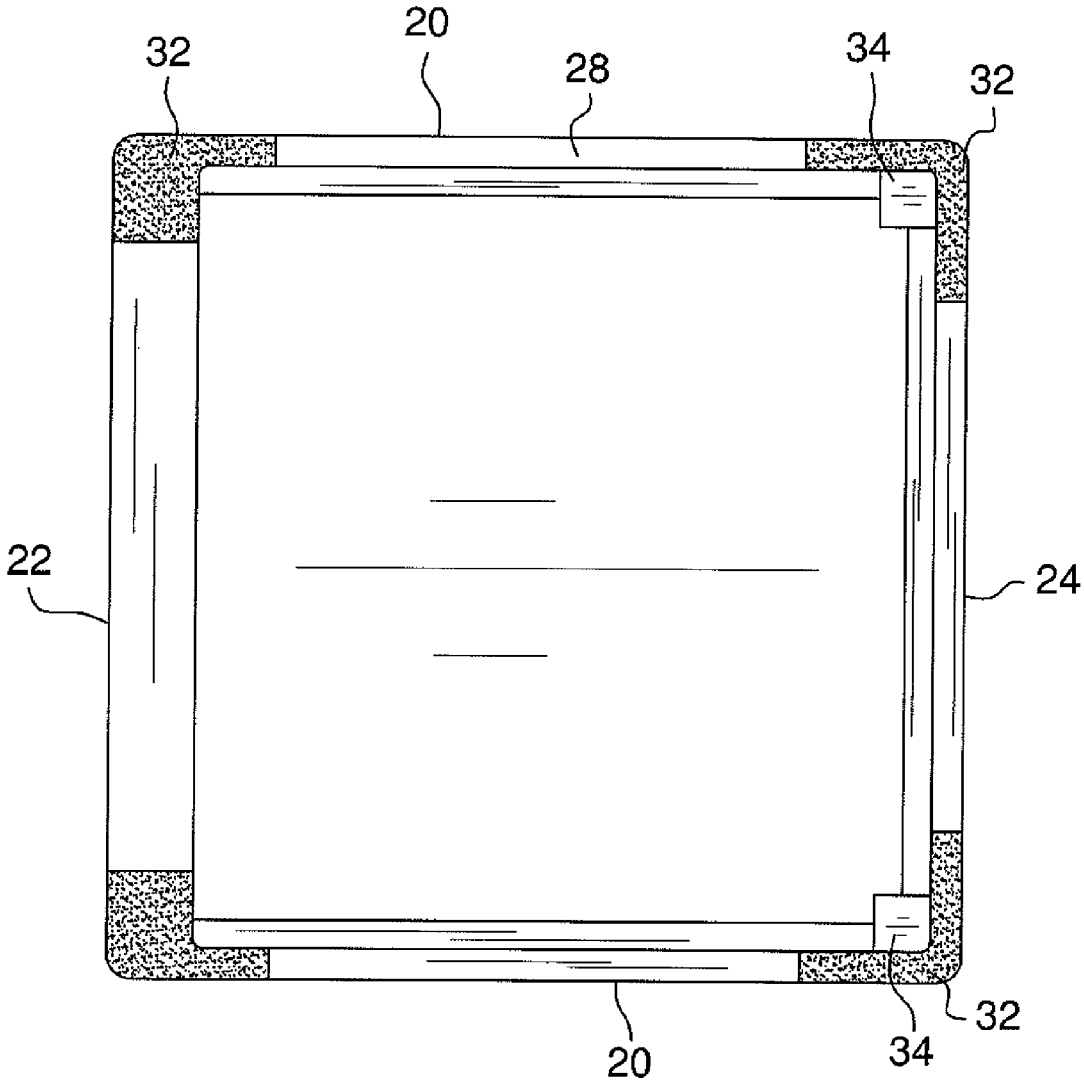
FIG. 4 is a bottom view of the present invention.
Figure 5:
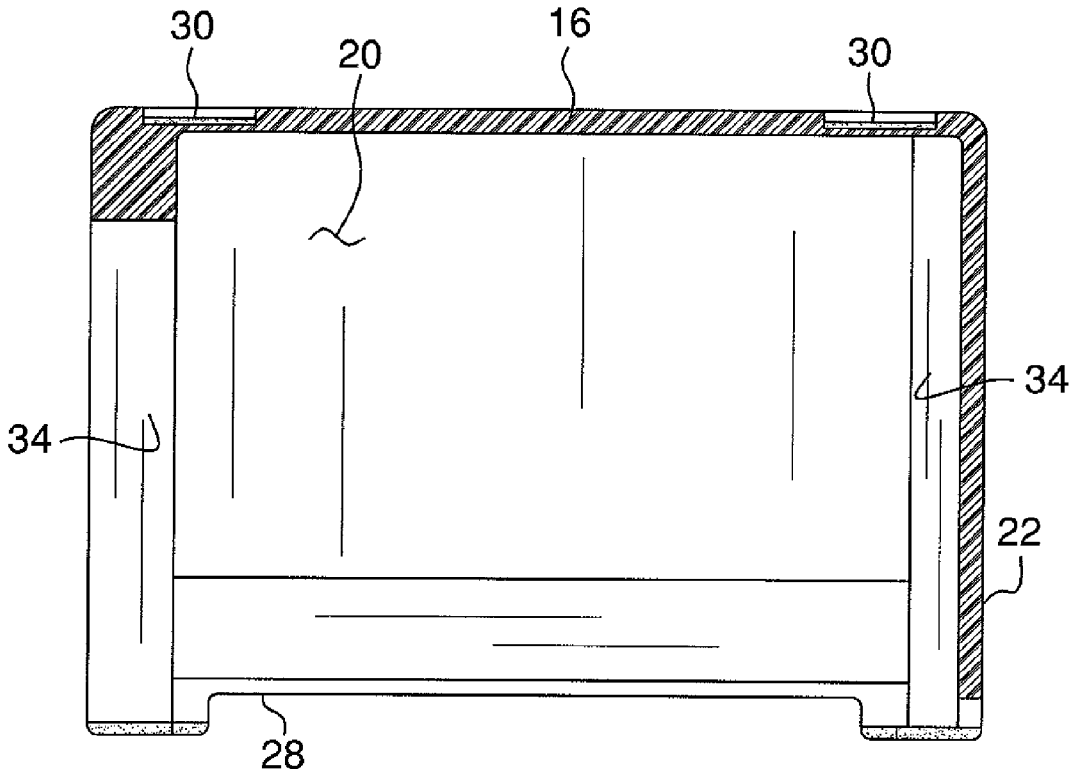
FIG. 5 is a cross-sectional view of the present invention taken along line 5-5 of FIG. 2.
Figure 6:
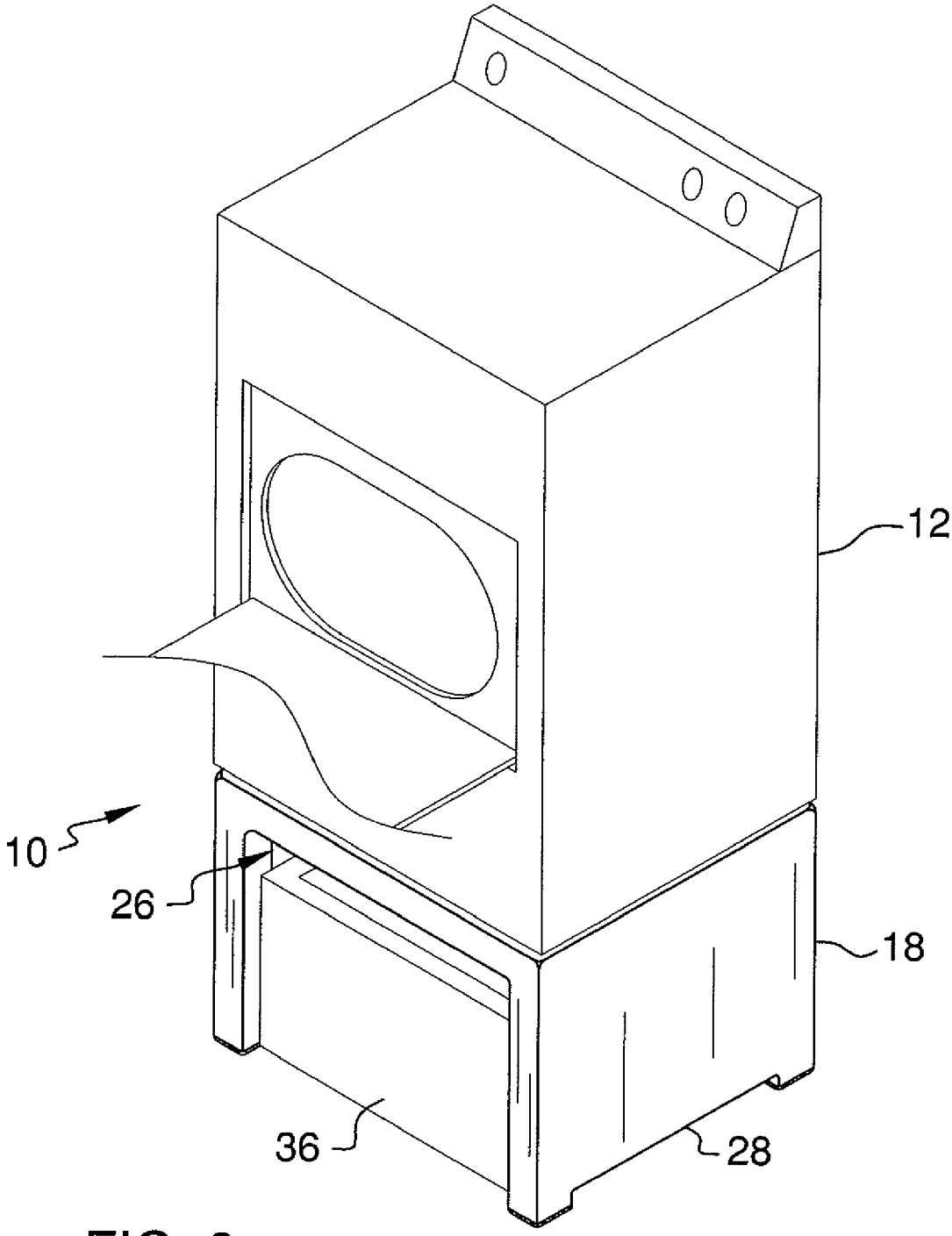
FIG. 6 is a front perspective in-use view of the present invention.

With reference now to the drawings, and in particular to FIGS. 1 through 7 thereof, a new appliance support device embodying the principles and concepts of the present invention and generally designated by the reference numeral 10 will be described.

As best illustrated in FIGS. 1 through 7, the clothes cleaning device support system 10 generally comprises a clothes cleaning device 12 for washing clothes, drying clothes or both washing and drying clothes. The clothes cleaning device 12 may therefore include a conventional clothes washer, a clothes dryer or a combination of the two.

A mount 14 is provided for supporting the clothes cleaning device 12 over a floor surface. The mount 14 includes a top wall 16 and a perimeter wall 18 that is attached to and extends downwardly from the top wall 16. The perimeter wall 18 includes a pair of side walls 20, a rear wall 22 and a front wall 24. The front wall 22 has an access aperture 26 therein to access an area below the top wall 16. The access aperture 26 extends upwardly into a bottom edge 28 of the perimeter wall 18 and toward the top wall 16. The top wall 16 has a plurality of indentations 30 therein. Each of the indentations 30 is positioned to receive a footing of the clothes cleaning device 12 and are covered with a non-slip material. The clothes cleaning device 12 is positioned on the top wall 16 and the mount 20 has a height between 1 foot and 3 feet.

A plurality of foot members 32 is attached to the bottom edge 28. Each of the foot members 32 is comprised of a resiliently compressible non-slip material. The material may be comprised of all elastomer.

Figure 7:
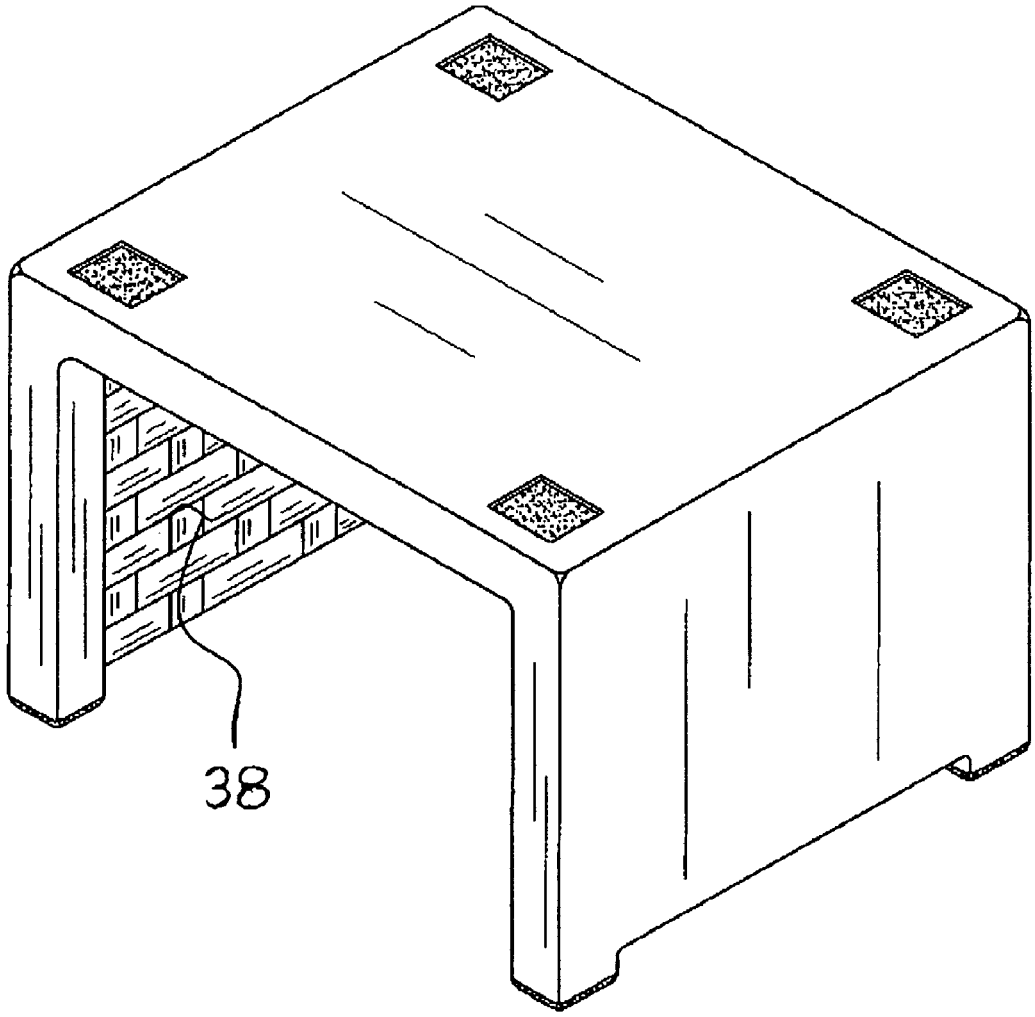
FIG. 7 is a front perspective view of a second embodiment of the present invention.

A plurality of bracing members 34 is mounted in the mount 14 and is attached to the perimeter wall 18 and may be integral with the perimeter wall. Each of the bracing members 34 is vertically oriented and positioned adjacent to one of four corners in the perimeter wall 18. Each of the bracing members 34 extends from the top wall 16 to one of the foot members 32. The bracing members 34 are each positioned to be located at least partially in alignment with one of the indentations 30. FIG. 7 shows a second embodiment of the system 10 including a webbing material 38 used to add additional support to the perimeter wall 18.

In use, the clothes cleaning device 12 is placed on the mount 14 so that the clothes cleaning device 12, particularly if it is a model having a front access door, is more accessible and will require less bending over by its user. Further, the mount 14 allows a container 36 to be positioned under the top wall 16 and is accessible through the access aperture 26. The container 36 may hold clothes or items used in the clothes cleaning process.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clothes cleaning device support system comprising:

a clothes cleaning device for washing clothes, drying clothes or both washing and drying clothes;

a mount for supporting the clothes cleaning device over a floor surface, said mount including a top wall and a perimeter wall being attached to and extending downwardly from said top wall, said perimeter wall including a pair of side walls, a rear wall and a front wall, said front wall having an access aperture therein to access an area below said top wall, said access aperture being bounded on only three sides including an upper edge and a pair of lateral edges and said front wall being free of a bottom edge of said perimeter wall, said top wall having a plurality of indentations therein, each of said indentations being positioned to receive a footing of said clothes cleaning device, said clothes cleaning device being positioned on said top wall, said mount having a height between 1 foot and 3 feet, each of said indentations being covered with a non-slip material;

a plurality of foot members being attached to said bottom edge, each of said foot members being comprised of a resiliently compressible non-slip material;

a plurality of bracing members being mounted in said mount and being attached to said perimeter wall, each of said bracing members being positioned adjacent to one of four corners in said perimeter wall, each of said bracing members extending from said top wall to one of said foot members; and wherein a container is positionable under said top wall and is accessible through said access aperture.

* * * * *